United States Patent [19]

Wolfert

[11] 4,325,290

[45] Apr. 20, 1982

[54] FILTERED ROOF RIDGE VENTILATOR

[75] Inventor: Clarke K. Wolfert, Peoria, Ill.

[73] Assignee: Air Vent, Inc., Peoria, Ill.

[21] Appl. No.: 194,581

[22] Filed: Oct. 6, 1980

[51] Int. Cl.[3] ..... F24F 7/02

[52] U.S. Cl. ..... 98/42 A; 55/385 C; 55/385 F; 55/487

[58] Field of Search ..... 52/198, 199; 98/2, 11, 98/32, 35, 37, 42; 55/385 C, 385 F, 487

[56] References Cited

U.S. PATENT DOCUMENTS 1,898,859 2/1933 Thorp ..... 98/2.11
3,185,070 5/1965 Smith ..... 98/42 A

FOREIGN PATENT DOCUMENTS 676241 5/1950 United Kingdom ..... 98/37

*Primary Examiner*—Albert J. Makay
*Assistant Examiner*—Harold Joyce
*Attorney, Agent, or Firm*—Silverman, Cass & Singer, Ltd.

[57] ABSTRACT

A ridge ventilator for the roof of a building includes a porous, non-woven and fiberous filter medium selectively installed in the ventilator to prevent inadvertent infiltration of moisture through the ventilator into the space below the roof. The filter medium is retained in operative position engaged against louvered panels, outer side walls and at least portions of the top wall of the ventilator. The thickness of the filter medium preferably is greater than the height of the outer side walls so that the filter medium is frictionally retained in its operative position. The filter medium has a density gradient through its thickness with the most dense portion of the medium being arranged adjacent the louvered openings. In operative position, the filter medium will trap or filter moisture from air entering the ventilator from ambient atmosphere and yet, will permit exhausting of air through the ventilator to ambient atmosphere.

9 Claims, 6 Drawing Figures

FILTERED ROOF RIDGE VENTILATOR

BACKGROUND OF THE INVENTION

This invention relates to ventilators for the space below the roof of a building and, in particular, relates to roof ridge ventilators for exhausting air from the attic of a house.

Roof ridge ventilators are installed overlying the open ridge of and along the length of a building for exhausting heated air from the space below the roof of the building. These ventilators are installed in cooperation with ventilators at the soffits of the building roof to provide a ventilation system in which air is exhausted from the space below the roof through the roof ridge ventilator and is replenished through the soffit ventilators. An example of such a ventilator system is disclosed in U.S. Pat. No. 3,036,508.

Ventilation of the attic of a building has become increasingly important to remove the gaseous water vapor which migrates into the attic from the living quarters of the building. This migrated water vapor when condensed into liquid water in a cold attic above the living quarters can reduce the rating of installation installed in the attic and can have deleterious effects on the structure of the roof if not removed. Ventilation of the attic thus is important to remove this airborne water vapor from the attic.

In an optimum roof ridge soffit ventilator system, there is a balance between the net free open area presented by both the roof ridge and soffit ventilators. The phase "net free open area of a ventilator" is intended to mean the cross sectional area of a ventilator which is open for passage of air therethrough. A balance between the net free open area of a roof ridge and soffit ventilator is difficult to obtain. In many new homes there is a lack of sufficient soffit area in which to provide the soffit ventilators. Most existing homes do not have sufficient soffit ventilation to provide the balanced system. Remodeling contractors and home owners are unwilling to install soffit ventilators and in many cases, it is difficult to do so. In many instances, fire codes prevent the installation of soffit vents within three feet of doors and windows. Further, in homes such as those having cathedral ceilings, the insulation in the space below the roof would prevent the clear passage of air from the soffit ventilators to the roof ridge ventilator even if soffit ventilators were installed. Thus, in many new and existing homes there is an occurrence of an out of balance roof ridge/soffit ventilator system.

These out of balance ventilation systems are subject to several problems, one of which is the infiltration of moisture through the ventilators. An out of balance system favoring the soffit vents will produce a weak ventilation system but little harm will occur from infiltration of moisture through the roof ridge or soffit ventilators into the space below the roof of the building. In an out of balance system favouring the roof ridge ventilators, however, a phemonenon occurs in response to normal winter winds that will infiltrate moisture such as snow through the roof ridge ventilator.

This phenomenon occurs when the wind currents are from a direction which is parallel to or at a small angle to the length of the roof ridge ventilator. This phenomenon provides low pressure areas along a windward portion of the roof ridge ventilator as a result of the wind striking the structure of the building below the roof and being deflected over the roof. These low pressure areas serve to exhaust air through the windward portion of the roof ridge ventilator from the space below the roof. Because of the unbalance of the ventilator system favoring the roof ridge ventilator, the air which is exhausted through the windward portion of the roof ridge ventilator is replenished by air being admitted in through the roof ridge ventilator and not the soffit ventilators. This admission of air occurs along a leeward portion of the roof ridge ventilator which is subject to high pressures as the deflected wind again approaches the roof. In winter months, this phenomenon will infiltrate moisture in the form of snow through the roof ridge ventilator and into the attic of the building. This snow subsequently will melt which causes damage to the structure of the building and additionally wets any insulation and reduces the insulation rating thereof.

Further, a roof ridge ventilator will infiltrate moisture such as snow with winds occurring at other angles when a roof ridge ventilator is installed on a roof having a pitch greater than 8/12 without the use of a shim commonly known as a cant strip between the ventilator and the building roof.

The invention prevents the infiltration of moisture such as snow through a ridge ventilator by providing a high impedence to such moisture while presenting a low impedence for the air passing through the ridge ventilator.

It is known to provide a wire screen in a roof ridge ventilator to prevent the passage throughthrough of birds, insects or foreign manner. See U.S. Pat. No. 3,036,508, for example. There, a wire screen mesh is held over the free open areas of the ventilator by baffles which additionally act as splash guards. The screen has a thickness substantially the thickness of the wire forming the screen and presents what may be referred to as a single plane of openings for the air to pass through. As each opening between the wires becomes clogged by moisture such as snow or frost, the net free open area of the ventilator is reduced proportionately. Additionally, any moisture which passes through the plane of the screen is free to pass through to the space below the roof.

The invention provides a filter medium which is installed in the ventilator over the ventilator openings and which has a substantial thickness. The filter medium traps or blocks the passage of moisture such as snow passing through the openings. The ventilator openings thus may be much larger than the size of the snow particles which means that the openings will not easily become clogged by the snow and that the amount of the net free open area of the ventilator remains stable. The filter medium will filter the snow particles through out the thickness of the filter medium. Thus the snow particles have to travel a relatively long distance through the filter medium compared with the single plane of the wire screen before the snow particles are free to pass to the space below the building roof. Additionally, the snow particles trapped in the filter medium will not proportionally reduce the net free area of the ventilator. The air passing through the filter medium may move laterally through the filter medium and around filtered snow or other moisture and out of the ventilator to ambient atmosphere or to the attic space below the roof of the building It is known to use filter media to trap airborne particulate matter in ventilators, for example see U.S. Pat.

Nos. 2,171,400; 3,657,991 and 4,048,911. But every one of these references discloses the use of a filter medium in what may be called an active ventilator system where there is a motor driven fan for forcing the air through the ventilator. The roof ridge ventilator of the invention is distinguishable from these systems by the lack of the motor driven fan, such a roof ridge ventilator being what may be called a passive ventilator. Moreover, the filter media used in these active systems are intended to remove dirt and dust and are not intended to remove or prevent the infiltration of moisture such as snow or rain through a ventilator.

SUMMARY OF THE INVENTION

A roof ridge ventilator includes a resilient filter medium installed therein to provide a high impedance to the inadvertent infiltration of moisture such as rain or snow through the roof ridge ventilator to the space below the roof of a building while providing a low impedance for air passing through the ventilator.

The roof ridge ventilator is an elongate sheet metal member presenting a top, a pair of depending outer side walls, a pair of panels with louvered openings therein extending from the side walls inwardly toward one another and being spaced below the top part, wall means on the panels forming a throat to be placed in registry with the open ridge of a building roof, flashing parts spaced below the panels extending outwardly from the walls and protruding beyond the outer side walls, and baffles upstanding from ends of the flashing parts and selectively spaced from the outer side wall to achieve low pressure areas in the vicinity of the outer side walls for enhancing exhaustion of air through the louvered openings from the space below the roof.

The filter medium preferably has a thickness greater than the height of the side walls and extends the length of the sheet metal member. The filter medium is retained in operative position engaged over the louvered openings and is frictionally retained in an operative position between the pair of panels, the side walls and at least a portion of the top part adjacent the side walls.

DESCRIPTION OF THE PREFERRED EMBODIMENT

The invention is described in connection with a roof ridge/soffit ventilation system in which a roof ridge ventilator is installed overlying the open ridge of a building. It is believed that the invention herein is broader than this particularly described embodiment in that the invention may be used in any ventilator system where there is a greater net free open area in a roof ridge ventilator than in any other ventilator of the ventilator system.

Figure 1:
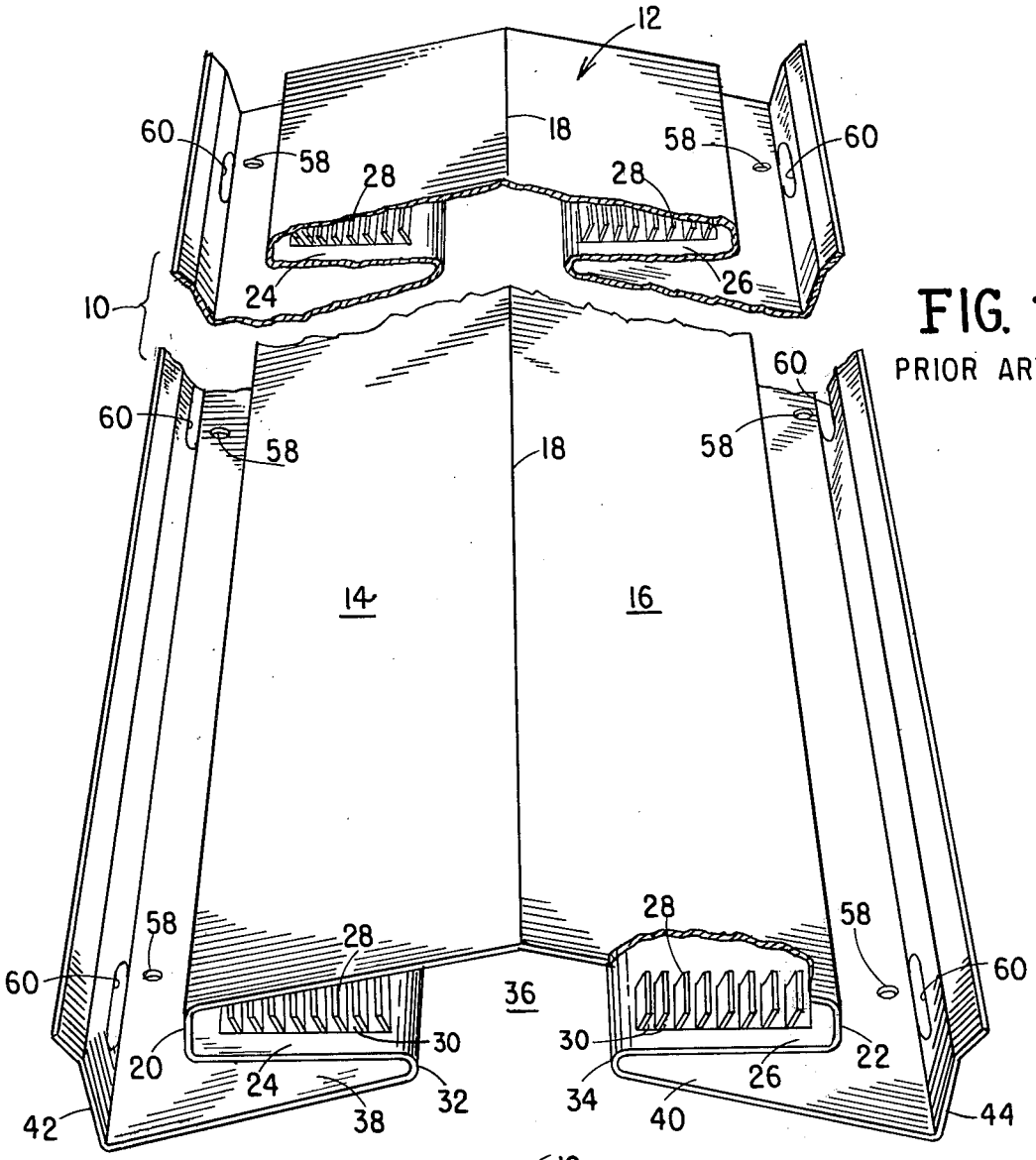
FIG. 1 PRIOR ART
FIG. 1 is a perspective view of a length of roof ridge ventilator having a portion broken out therefrom.
Figure 2:
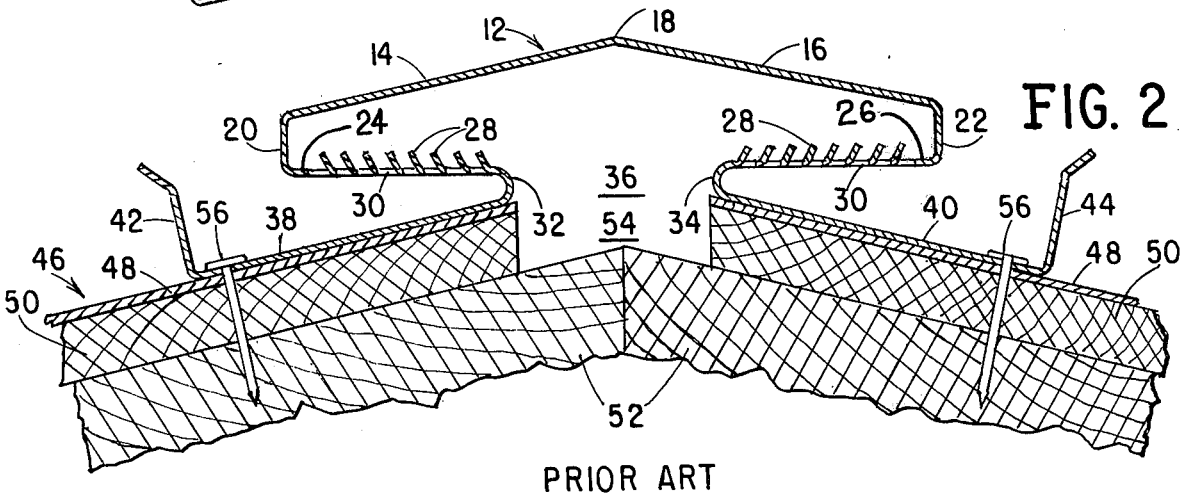
FIG. 2 PRIOR ART
FIG. 2 illustrates the roof ridge ventilator of FIG. 1 in elevation from an end thereof and mounted on a section of a roof of a building.

Turning to FIGS. 1 and 2, a known roof ridge ventilator is illustrated which is indicated generally by the reference character 10. The roof ridge ventilator 20 is an integral, elongate sheet metal member formed to have essentially mirror image left and right halves. Roof ridge ventilator 10 provides a top part 12 having both a left top part 14 and a right top part 16 depending from a central apex 18. A pair of outer side walls 20 and 22 depend from the outer edges of left and right top parts 14 and 16, respectively. A pair of panels 24 and 26 extend from said side walls 20 and 22, respectively, inwardly toward one another and are spaced below the top part 12. Panels 24 and 26 are provided with louvers 28 which are integrally formed with panels 24 and 26. Louvers 28 are directed inwardly of roof ridge ventilator 10 and further are directed outwardly towards outer side walls 20 and 22. Louvers 28 provide openings 30 through panels 24 and 26.

Inner side walls 32 and 34 on panels 24 and 26 respectively form a throat 36. Flashing parts 38 and 40 are spaced below panels 24 and 26 and, respectively, extend outwardly from the inner side walls 32 and 34 to protrude beyond the outer sidewalls 20 and 22. Baffels 42 and 44 upstand from ends of the flashing parts 38 and 40, respectively, and are selectively spaced from the outer side walls 20 and 22 to achieve low pressure areas in the vicinity of the outer side walls to enhance exhaustion of air through the louvered openings 30 and the throat 36.

Roof ridge ventilator 10 is mounted on a building roof generally indicated by the reference character 46. Roof 46 includes sheathing 48 overlying roof boards 50. The roof boards 50 are carried by rafter members 52. The ridge of roof 46 is provided with an opening 54 and ventilator 10 is installed on roof 46 with the throat 36 in registration with the opening 54. Ventilator 10 is secured to roof 46 by fasteners such as nails 56 extending through nail holes 58 in flashing parts 38 and 40, and passing into sheathing 48, roof boards 50 and rafter members 52. Apertures 60 which are commonly known as weep holes are provided in baffles 42 and 44 at spaced distances from one another along the length of the ventilator 10 to provide for moisture to drain from the ventilator 10.

In operation, the roof ridge ventilator 10 exhausts air through the louvered openings 20 from the space below the roof 46 in response to the low pressure areas formed in the vicinity of the outer side walls 20 and 22. These low pressure areas are formed by the wind or air currents impinging on ventilator 10 from a direction which is normal to or at a great angle to the length of ventilator 10.

Figure 3:
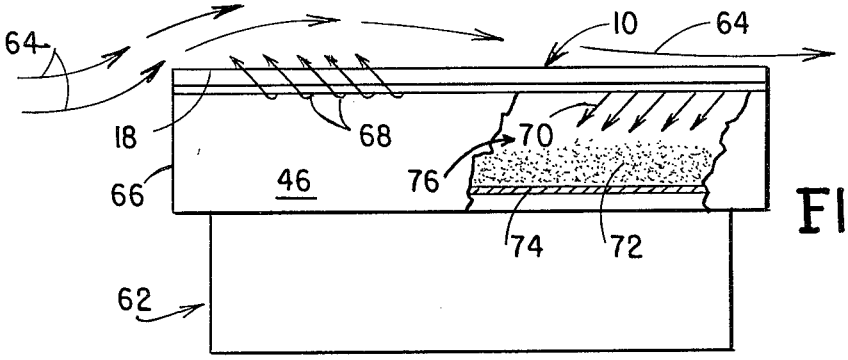
FIG. 3 is a schematic diagram illustrating with arrows wind currents occurring at a small angle to the length of a roof ridge ventilator installed on the roof of a building and further illustrating with arrows the exhaustion and admission of air from and to the space below the roof of the building.

In FIG. 3, a building 62 is illustrated having a roof ridge ventilator 10 installed on the roof 46 thereof. The wind, represented by arrows 64, is passing at a small angle such as parallel to or at an oblique angle to the length of the roof ridge ventilator 10. The wind as represented by arrows 64 is deflected up and over roof 46 as it strikes the edge 66 or roof 46 and provides a low pressure area along a windward portion of ventilator 10 adjacent edge 66 of roof 46.

This low pressure area is caused by the wind being deflected upwards over roof 46 by the edge 66 and is not caused by the wind impinging on ridge ventilator 10. In fact, because of the small angle at which the wind is impinging upon ventilator 10, there is little or no production of low pressure areas adjacent the side walls 20, 22 caused by the wind impinging on ventilator 10.

The low pressure area caused by the wind being deflected up and over roof 46 results in air being exhausted from the windward portion of ventilator 10, this exhausted air being indicated by arrows 68.

Building 62 is provided with an unbalanced ventilator system in which there is little or no net free open area provided by any soffit vents and in which there is a large net free open area provided by the roof ridge ventilator 10. Replenishment of the exhausted air prepresented by arrows 68 then must occur by way of an admission of air represented by arrows 60 through a leaward portion of ventilator 10. In winter months the admission of air such as is represented by arrows 70 can infiltrate moisture such as snow 72 through ventilator 10 into the space below the roof 46. When snow 72 melts in the attic space below the roof 46, the resulting water reduces the efficiency of installation 74 and damages the structure of the roof.

Figure 4:
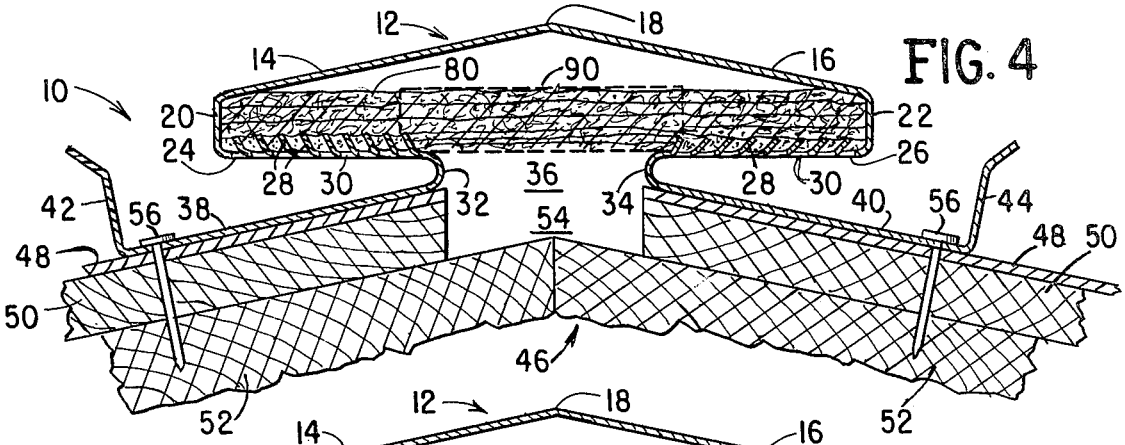
FIG. 4 is an end elevational view of one embodiment of the invention installed on a section of the roof of a building.
Figure 5:
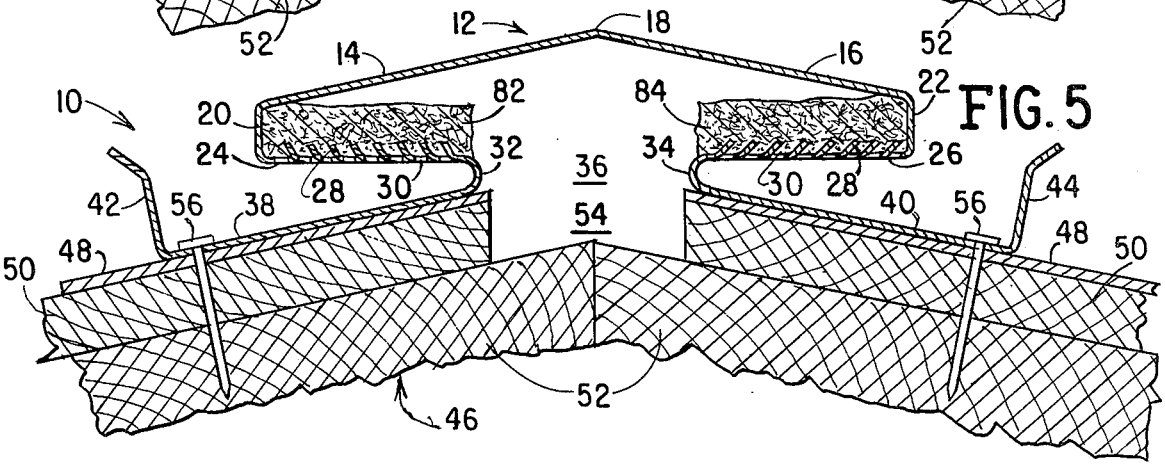
FIG. 5 is an elevational view of a second embodiment of the invention installed on a section of the roof of a building.
Figure 6:
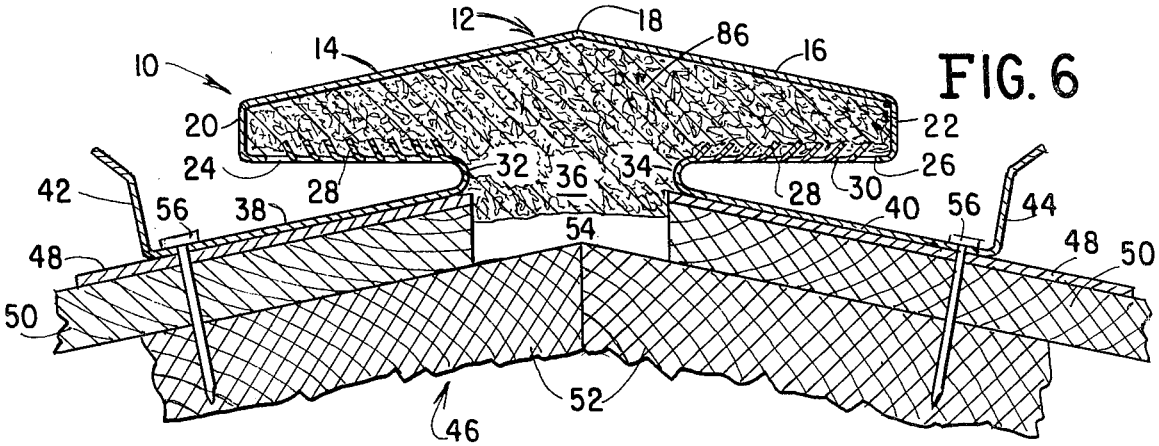
FIG. 6 is an elevational view of a third embodiment of the invention installed on a section of the roof of a building.

Referring now to FIGS. 4, 5 and 6 in which like elements have like reference characters, there are provided means for filtering moisture such as snow which otherwide may be admitted through roof ridge ventilator 10 to the space below the roof 46 of a building 62.

In FIG. 4 these means for filtering include a unitary filter medium 80 interior of roof ridge vnetilator 10 fromed of such as a porous, nonwoven, resilient fiber glass material. Filter media 80 is frictionally engaged in operative position against louvers 28 and extends the length of roof ridge ventilator 10. Filter medium 80 extends from side wall 20 to side wall 22 and overlays throat 36. Filter medium 80 is engaged against louvers 28 by being compressed between marginal portions of top part 12 adjacent side walls 20 and 22, and panels 24 and 26, respectively.

In FIG. 5 there are a pair of filter mediums 82 and 84 overlying the louvers 28 of panels 24 and 26, respectively, and extending the length of ventilator 10. Filter medium 82 is frictionally engaged against louvers 28 by being compressed between at least a portion of top part 14 adjacent outer side wall 20, and panel 24. Filter medium 84 is frictionally engaged against the louvers 28 by being compressed between at least a portion of top part 16 adjacent outer sidewall 22 and panel 26.

FIG. 6 filter medium 86 occupies the entire interior volume of roof ridge ventilator 10 including the throat 36 and further extends partially into the opening 54 at the ridge of roof 46. Filter medium 86 like media 80, 82 and 84 extends the length of roof ridge ventilator 10. Filter medium 86 is frictionally engaged against louvers 28 by being compressed between the entire top 12 and panels 24 and 26.

Filter media 80, 82, 84 and 86 are maintained frictionally engaged against the side walls 20 and 22 in part by the louvers 28, which are directed inwardly of ventilator 10 and outwardly towards sidewalls 20 and 22 with the sharp, pierced top edges of the louvers engaging with the media and preventing it from moving. The inherent resiliency of the filter media contributes to the frictional engagement of the filter media in an operative position especially concerning filter media 80 and 86. Louvers which are directed inward of the outer side walls may be used in conjunction with the described filter media.

Filter media 80 through 86 are made of any suitable filtering material such as non-woven fiber glass and have a density of about 0.456 pounds per cubic foot. The flow rate of air through the filter media is about 2 cubic feet per minute per square inch of cross section of the filter medium at a recommended air velocity of 300 feet per minute. The air velocity through the media in a 7.5 mph wind would be about 216 feet per minute. The initial air impedance or resistance of the filter media is about 0.07 inches of mercury at an air velocity of 300 feet per minute.

In a specific embodiment of the invention, the outer side walls 20, 22 have a height of $\frac{1}{2}$ inch, the distance between outer sidewalls 20, 22 is about 5 and $\frac{3}{4}$ inches and the roof ridge ventilator 10 is formed in lengths of about 10 feet. In this specific embodiment, filter medium 80 would be used as manufactured without a cartridge containment and have dimensions as follows: a thickness of about 1 inch, a width of about 6 inches, and a length of 10 feet. The 1 inch thickness of the filter medium 80 is compressed into the $\frac{1}{2}$ inch space between the outer margin of top part 14 and panel 24 and between the outer margin of top part 16 and panel 26. The filter medium 80 has a resiliency which is sufficient to hold the filter medium frictionally engaged against louvers 28 so that filter medium 80 will not be lifted away from louvers 28 by admitted air. The rough, pierced top edges of louvers 28 frictionally engage the filter medium 80 so that filter medium 80 will not move out of the confinement area and into the throat 36 of the vent 10. Similar dimensions are used for filter media 82–86 illustrated in FIGS. 5 and 6.

The filter media as manufactured has a density gradient through the thickness of the media to prevent a rapid build-up of particulate matter in the media. The dense side of the filter media is placed adjacent the louvers to maximize the filtration of moisture such as snow from admitted air and minimize any dust build-up from air being exhausted from the space below the roof of the building.

The filter media 80 through 86 provides a high impedence to moisture such as snow or even rain which otherwise would be infiltrated through roof ridge ventilator 10 in an inadvertent situation in which the wind is from a direction which is parallel to or at a small angle with the length of the roof ridge ventilator l0. The filter media presents a low impedance to the admission or exhaustion of air through roof ridge ventilator 10. The filter media will be self-cleaning from clogging due to snow or frost through the effects of sublimation and melting caused by the heat of the sun and the heat of the air exhausted through the ventilator from the space below the roof.

Even with the filter media installed in the roof ridge ventilator 10, the amount of the air movement through ventilator 10 is sufficient to provide for any water vapor to be evacuated from the space below the roof of a building providing proper ventilation therefor.

In a further embodiment, a filter medium 90, shown in dashed line outline in FIG. 4, can be shorter in width than the distance between the sidewalls 20, 22 to be effective. The important feature is that the filter medium 90 span the throat 36 or opening 54, and be sufficiently fixed to remain in such operative position.

Further, a filter medium may be located only in the throat 36 or between throat 36 and opening 54 or even yet, only in opening 54 and still be effective to filter moisture. Of course, such a filter medium located in throat 36, opening 54 or therebetween needs to be fixed in operative position by such as friction, a screen, hardware cloth or by being nailed to the roof. The important feature again, is that the filter medium span the throat 36 or opening 54 so that moisture may not by pass the filter medium and pass into the space below the roof.

Modifications and variations of the present invention are possible in light of the above teachings. It is therefore to be understood that within the scope of the appended claims, the invention may be practiced otherwise than as specifically described.

What is desired to be secured by Letters Patent of the United States is:

1. In roof edge ventilator adapted to be installed overlying the open ridge of and along the length of the roof of a building, said ventilator including an integral, elongate member providing a top part, a pair of outer side walls depending from the top part, a pair of panels with louvered openings extending from said side walls inwardly toward each other and spaced below the top part, wall means on said; panels forming a throat in registry with the open ridge, flashing parts spaced below the panels extending outwardly from said wall means and protruding beyond the outer side walls, and baffle means upstanding from ends of the flashing parts and spaced from said outer side walls; the improvement comprising: means for filtering moisture from any air which passes inadvertently from said space between the baffles and side walls to enter the space below the roof through said louvered openings as a result of external winds impinging against the ventilator from a direction which is at a small angle relative to the length of the ventilator, comprising: (a) a moisture filter medium located between the louvered openings and the space below the roof in the path of air extending from the louvered openings through the throat and open ridge to the space below the roof, so that all air passing through the elongate member to and from the space below the roof must pass through the filter medium; and (b) the filter medium being a porous, resilient, nonwoven member having a high impedance to moisture and a low impedance to air flow and having a substantial thickness selected so that air passing into the filter medium from the space below the roof and striking said moisture may move laterally of and around the trapped moisture and through the ventilator for exhausting to ambient atmosphere, whereby in freezing conditions any moisture collected in said filter medium may freeze, thereby closing off or restricting inflow through the louvered openings.

2. The ventilator as claimed in claim 1 in which the filter medium is engaged over said louvered openings and extends the length of the elongate member, the filter medium being frictionally engaged between the pair of panels, the side walls and at least portions of the top part adjacent the side walls.

3. The ventilator as claimed in claim 2 in which the pair of outer side walls have a height and the filter medium has a thickness greater than the height of the side walls.

4. The ventilator as claimed in claim 3 in which the filter medium is compressed between the pair of panels and the portions of the top part adjacent the side walls.

5. The ventilator as claimed in claim 2 in which the ventilator has an interior, the pair of panels have louvers forming the louver openings, the louvers having sharp pierced free edges extending into the interior of the ventilator and the filter medium being frictionally engaged between the sharp pierced edges, the side walls and at least portions of the top part adjacent the side walls.

6. The ventilator as claimed in claim 2 in which the filter medium has a density gradient through the thickness thereof and the filter medium is located in the interior of the ventilator with the most dense portion adjacent the louvered openings.

7. The ventilator as claimed in claim 2 in which the filter medium is a unitary structure and extends from side wall to side wall.

8. The ventilator as claimed in claim 7 in which the filter medium substantially fills at least the interior of the ventilator.

9. The ventilator as claimed in claim 2 in which the filter medium includes a first portion and a second portion, the first portion being held between one of the panels, one of the side walls and at least a portion of the top part adjacent the one side wall, and the second portion of the filter medium being held between the other panel, the other side wall and at least a portion of the top part adjacent the other side wall.

* * * * *

UNITED STATES PATENT AND TRADEMARK OFFICE

CERTIFICATE OF CORRECTION

PATENT NO. : 4,325,290

DATED : April 20, 1982

INVENTOR(S) : CLARKE K. WOLFERT

It is certified that error appears in the above-identified patent and that said Letters Patent are hereby corrected as shown below:

Column 1, line 32, change "phase" to --phrase--;

Column 4, line 10, first occurrence, change "10" to --20--;

" " " 53, change "20" to --30--;

Column 5, line 17, change "prepresented" to --represented--;

" " " 18, change "60" to --70--;

" " " 23, after the word "space" insert --76--;

" " " 24, change the word "installation" to --insulation--;

" " " 32, change "vnetilator" to --ventilator--;

" " " 33, change "fromed" to --formed--;

Column 7, line 16, change "roof edge" to --a roof ridge--;

" " " 23, remove the semicolon (;) after the word "said".

Signed and Sealed this

*Thirteenth* Day of *July 1982*

[SEAL]

*Attest:*

GERALD J. MOSSINGHOFF

*Attesting Officer*

*Commissioner of Patents and Trademarks*